US005193522A

United States Patent [19]

Damsteegt et al.

[11] Patent Number: 5,193,522

[45] Date of Patent: Mar. 16, 1993

[54] ELECTRIC, GAS, COMBINATION OR SIMILAR OVEN PROVIDED WITH A DOOR, THE GLASS SURFACE OF WHICH IS KEPT AT A LOW TEMPERATURE

[75] Inventors: Johannes A. G. P. Damsteegt, Eindhoven, Netherlands; Mario Fioroli, Brezzo di Bedero, Italy; Giovanni Franzetti, Ispra; Franciscus Kokkeler, Malnate, both of Italy

[73] Assignee: Whirlpool International B.V., Eindhoven, Netherlands

[21] Appl. No.: 860,285

[22] Filed: Mar. 2, 1992

Related U.S. Application Data

[63] Continuation of Ser. No. 647,130, Jan. 29, 1991, abandoned.

[30] Foreign Application Priority Data

Feb. 1, 1990 [IT] Italy ..... 20546/90[U]

[51] Int. Cl.[5] ..... F23M 7/00

[52] U.S. Cl. ..... 126/200

[58] Field of Search ..... 126/200

[56] References Cited

U.S. PATENT DOCUMENTS

| | | | |
|---|---|---|---|
| 3,507,267 | 4/1970 | Lafforgue | 126/200 |
| 3,720,196 | 3/1973 | Barnett et al. | 126/200 |
| 3,863,619 | 2/1975 | Wolf | 126/200 |
| 3,881,462 | 5/1975 | Barnett . | |
| 4,022,183 | 5/1977 | Martin | 126/200 |
| 4,127,101 | 11/1978 | Tilton | 126/200 |

FOREIGN PATENT DOCUMENTS 1009108 4/1977 Canada .

*Primary Examiner*—Carroll B. Dority

*Attorney, Agent, or Firm*—Thomas J. Roth; Stephen D. Krefman; Thomas E. Turcotte

[57] ABSTRACT

An electric, gas combined or similiar oven (1) is provided comprising a door (3) provided with a window (4), said window having an outer (5) and an inner surface (6) and a panel (9) interposed therebetween, said panel (9) comprises at least one mobile portion (25, 26) which when moved within the door (3) allows visual access to the interior of the usual cooking chamber (2) of the oven (1), the movement of said portion (25, 26) being controlled from the outside of said oven (1) by a suitable control member (40).

9 Claims, 3 Drawing Sheets

ELECTRIC, GAS, COMBINATION OR SIMILAR OVEN PROVIDED WITH A DOOR, THE GLASS SURFACE OF WHICH IS KEPT AT A LOW TEMPERATURE

This is a continuation of application Ser. No. 07/647,130, filed Jan. 29, 1991, and now abandoned.

FIELD OF THE INVENTION

This invention relates to an electric, gas, combination (i.e. provided with electrical resistance elements and a microwave generator) or similar oven either associated or not associated with a cooker or built into the structure of a kitchen.

BACKGROUND OF THE INVENTION

In an oven of the aforesaid type, there is the known problem that on operating the heat generator (resistance element or burner) the transparent, generally glass surface (window) of the usual closure door heats up and attains high temperature.

In particular and by way of example, if the oven temperature reaches 250° C., the outer surface of the door window reaches temperatures close to 90° C.

This can obviously cause problems if the user inadvertently touches said surface.

Various solutions have been proposed to overcome this problem, one of which, forming the subject of a prior proposal of the present applicant, relates to a door in which a window is provided comprising, within the body of the door, two surfaces of transparent material, preferably glass, said surfaces being positioned parallel to each other and at a short distance apart. This door is characterized in that a further wall of a material that is not transparent to heat, e.g., to radiant energy is inserted between said two surfaces, and is spaced apart at least from that surface more outwards of the oven cooking chamber, said wall comprising at least one aperture which enables the user to see into the interior of the oven. Preferably, air circulation is provided within the interspaces present between each surface and said wall.

Although this solution solves the aforesaid problems relative to excessive heating of the outer surface of the door window, it does not enable this surface to be kept at a temperature very close to the temperature of the environment in which the oven is located. In addition, the aperture provided in the wall between the inner and outer surfaces of said window does not always allow good visibility of the oven interior.

Again, if this aperture is constructed by providing a number of perforations in said wall (to form a sort of grating), the user can view the interior of the oven only from a predetermined position, and this can prove uncomfortable.

SUMMARY OF THE INVENTION

An object of the present invention is to provide an oven comprising a door provided with a window, said window having an outer and an inner surface and a panel interposed therebetween, which obviates the drawbacks of analogous arrangements of the state of the art.

A particular object of the invention is to provide an oven of the aforesaid type which enables the temperature at the outer surface of said window of said door to be considerably reduced.

A further object is to provide an oven of the aforesaid type which allows easy visual access to the interior of its usual cooking chamber, said access being obtained from various positions.

These and further objects which will be apparent to the expert of the art are attained by an oven of the aforesaid type, characterized in that the panel comprises at least one mobile portion which when moved within the door allows visual access to the interior of the oven cooking chamber, the movement of said portion being controlled from the outside of said oven by a suitable control member.

BRIEF DESCRIPTION OF THE DRAWING

The present invention will be more apparent from the accompanying drawing, which is provided by way of non-limiting example and in which.

DETAILED DESCRIPTION OF THE PREFERRED EMBODIMENTS

Figure 1:
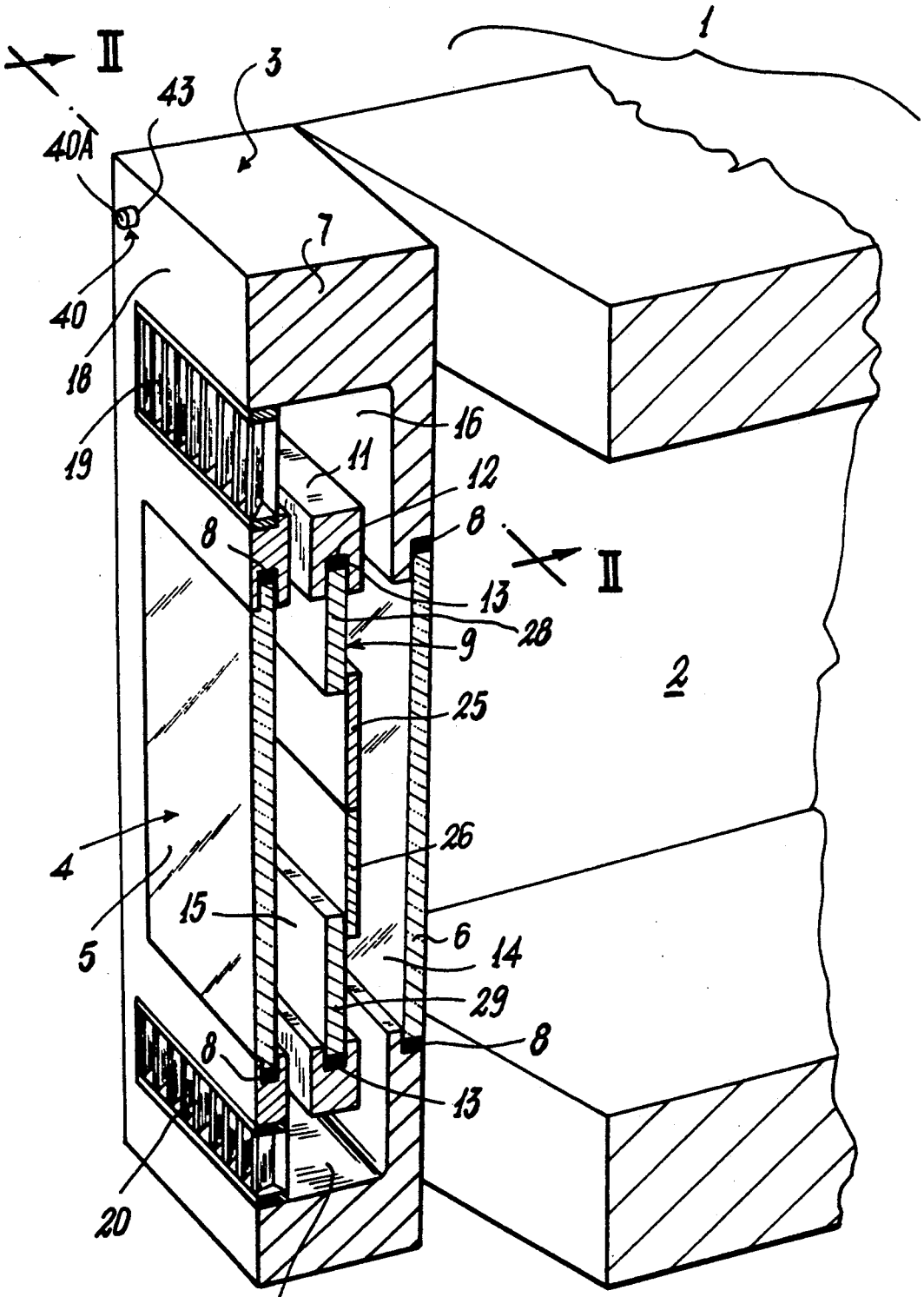
FIG. 1 is a perspective partial front view of an oven with a sideways opening door constructed in accordance with the present invention.
Figure 2:
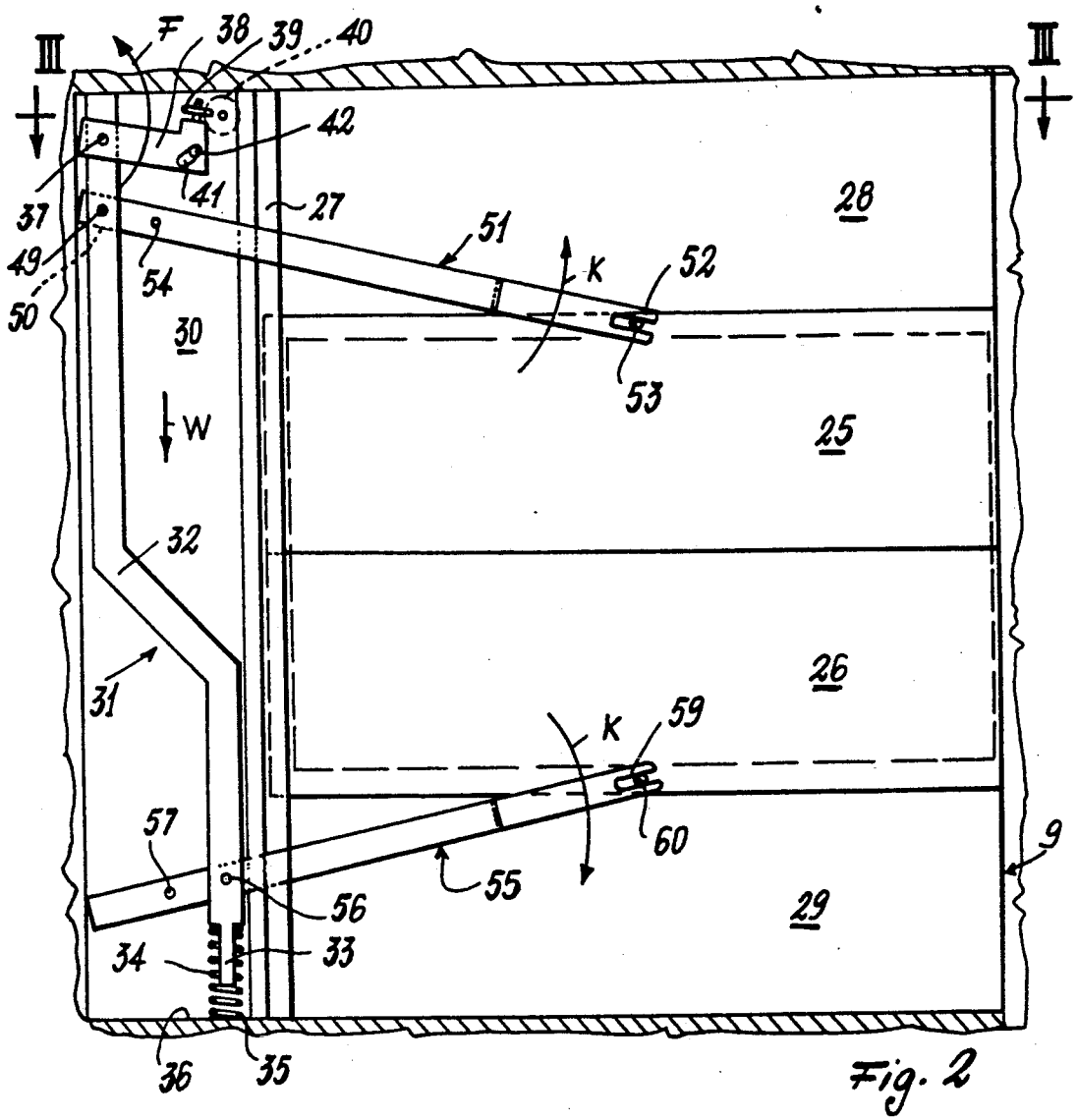
FIG. 2 is a section on the line II—II of FIG. 1.
Figure 3:
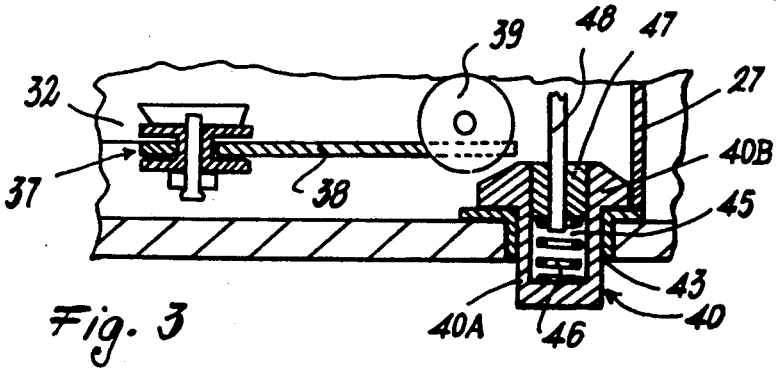
FIG. 3 is a section on the line III—III of FIG. 2.

With reference to FIGS. 1, 2 and 3, the oven which can be a usual electric resistance element, gas or combination oven) comprises a casing 1 in which there is a cooking compartment or chamber 2 provided with a door 3. The door has a window 4, comprising two transparent surfaces 5 and 6 (external and internal to the oven), preferably of glass, provided parallel to each other a certain distance apart. The two surfaces are supported by the body 7 of the door 3 in known manner, usual seal means 8 being provided at the opposite ends of each of said surfaces.

Between the two surfaces 5 and 6 there is provided a wall 9 of a material that is not transparent to the heat, e.g. radiant energy generated within the cooking chamber 2, and advantageously of zinc or chromium plated sheet iron, aluminum alloy or another similar material. The wall 9 is supported by a frame 11 formed within the door body 7 or associated with said body in any known manner. In particular, in the embodiment of FIG. 1, the wall 9 is inserted into a perimetral recess 12 of the frame 11, usual seal elements 13 being advantageously provided between the wall 9 and said frame. However, the wall 9 can be associated with the frame 11 in any other known manner.

The wall 9 can be provided at any point between said surfaces 5 and 6; for example, as shown, the wall 9 can be arranged to define two interspaces 14 and 15 between it and said surfaces 5, 6. In the embodiment shown in the figures, these interspaces connect together two cavities 16 and 17 provided above and below the window 4 of the door 3. These cavities open into the front 18 of the door 3, where grilles 19 and 20 are positioned along the opening. The grilles are associated with said door in any known manner, for example by gluing them to the walls of said openings or by elastic snap-fitting.

Alternatively, the cavity 17 can open into the underside of the door 3, in which case the grille 20 does not necessarily have to be provided over the opening.

According to the invention, the wall 9 comprises at least one mobile portion which when moved within the door 3 provides visual access to the interior of the cooking chamber 2 from the outside of the oven.

More specifically, in the described example the wall 9 comprises two mobile portions 25 and 26 which move in guides 27 along fixed portions 28 and 29 of said wall 9, said fixed portions being associated with the aforesaid frame 11. Said guides 27 are disposed along side portions 30 of said wall 9, said side portions being constructed of metal, as are said fixed portions 28 and 29. On at least one of said portions 30 there is provided a lever system 31 for moving the mobile portions 25 and 26 in said guides 27.

This lever system comprises an element 32 positioned along said portion 30 and having one end 33 partly inserted into a compression spring 34 (which can be inserted into a suitable seat associated with the door 3) having its free end 35 resting on a fixed part 36 of said door. The element 32 is pivoted at 37 (in any known manner) to a member 38 acting as a lever and supporting a disc element 39 which cooperates with a pushbutton 40 projecting from the face 18 of the door 3 (or from the face of the oven 1 or from the top of the oven 1).

The member 38 comprises a cam 41 in which a pin 42 fixed to the portion 30 of the wall 9 slides. The pushbutton 40 comprises a part 40A projecting from an aperture 43 provided in the face 18 of the door 3 and a frusto-conical part 40B which cooperates with the disc element 39. The pushbutton 40 also comprises a cavity 45 containing a spring 46 against which there acts an element 47 slidable in said cavity and arranged on a rod-shaped guide 48 secured to a fixed part of the door 3. The pushbutton 40 is guided in its movement by said rod-shaped guide and by said guide 27 (or by another like element positioned to one side of the pushbutton).

To the element 32 there is pivoted at 49 one end 50 of an arm 51, the other end 52 of which is of fork shape and is arranged to receive a pin 53 associated with the mobile portion 25 of the wall 9. The arm 51 is also pivoted at 54 to the side portion 30 of said wall 9. Likewise, a further arm 55 is pivoted at 56 and 57 to the element 32 and to the side portion 30 of the wall 9 respectively; this arm also has a fork-shaped end 59 which receives a pin 60 associated with the mobile portion 26 of the wall 9.

It will now be assumed that an oven in which the door 3 is constructed in accordance with the invention is to be used, and that, specifically, the interior of the cooking chamber 2 containing an article for treatment is to be viewed. To do this, the pushbutton 40 is pressed so that the disc element 39 moves along its frusto-conical part 40B. Said element rises along said part to drag with it the member 38, which rotates about the pivot 37 (arrow F, FIG. 2). The limits of this rotation are defined by the movement of the pin 42 within the cam 41. As the member 38 rotates, the element 32 moves against the spring 34 (arrow W, FIG. 2). The element 32 therefore moves downwards in FIG. 2 to rotate the arms 51 and 55 about the respective pivots 54 and 57 (arrow K).

Said rotation results in the movement of the pins 53 and 60 within the fork-shaped ends 52 and 59; the lifting action generated by these latter on said pins results in the movement of the mobile portions 25 and 26.

These portions therefore move from their rest positions (shown in FIG. 2) in the guides 27 to create an opening in the wall 9 to enable the user to view from the outside the article contained in the cooking chamber 2. On releasing the pushbutton 40, the spring 34 urges the element 32 upwards in FIG. 2, so that the portions 25 and 26 move together to close the opening which had previously been formed.

Figure 4:
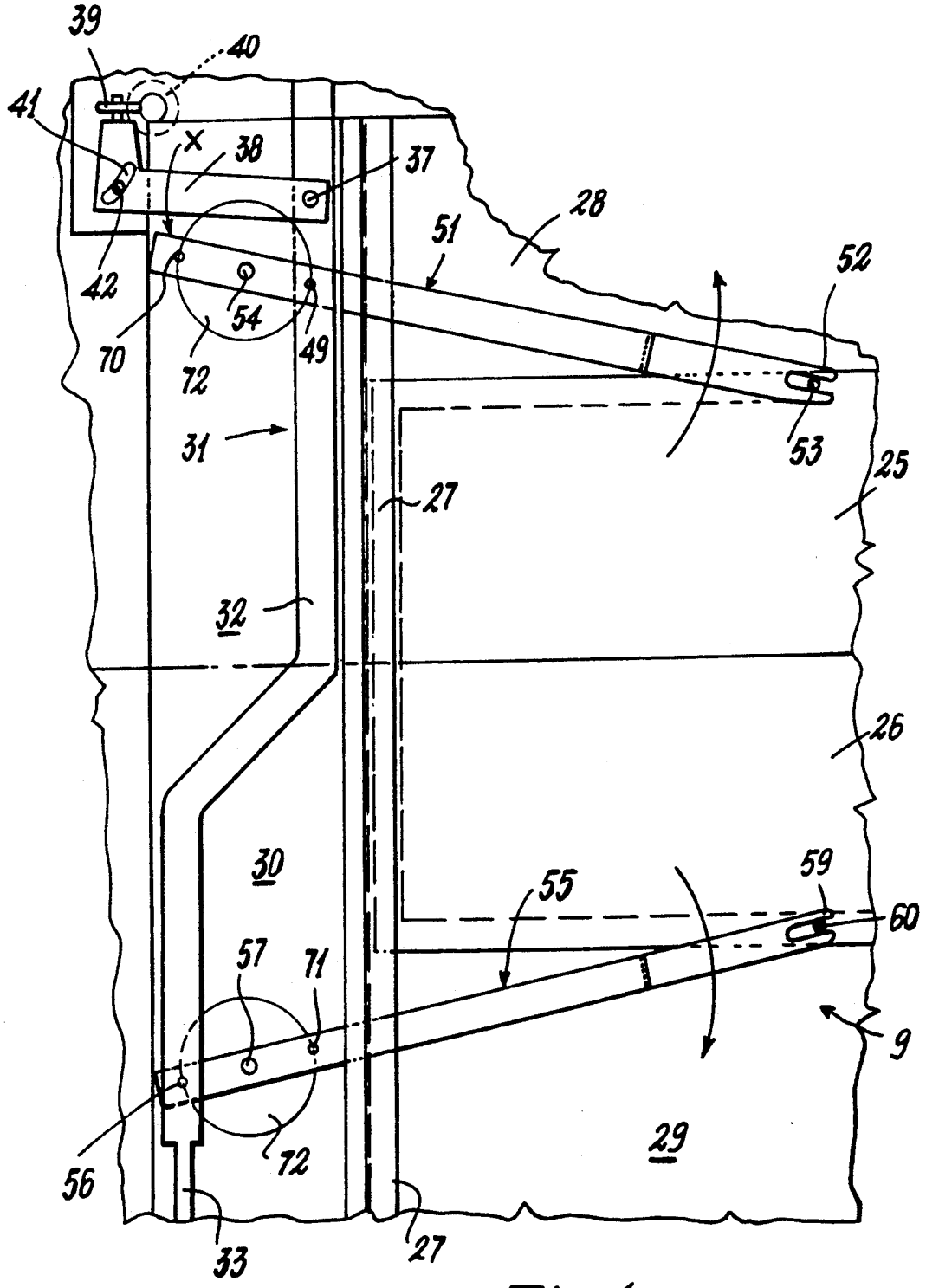
FIG. 4 is a section analogous to that of FIG. 2, but of a different embodiment of the invention.

FIG. 4 shows a further embodiment of the invention. In this figure, parts corresponding to those of FIGS. 1, 2 and 3 are indicated by the same reference numerals.

In said figure it can be seen that each arm 51 and 55 is pivoted to a fixed disc element 72 at 70 and 71 respectively. This increases the rigidity and mechanical strength of the system comprising the element 32 and s id arms.

The action of the pushbutton 40 on the disc element 39 results in a lowering (in FIG. 4) of the member 38 (arrow X, FIG. 4). The element 32 therefore rises with consequent rotation of the arms 51 and 55 (arrows Z, P) and movement of the portions 25 and 26 along the guide 27.

Any other known elastic, mechanical or motordriven device can replace the lever system 31 and be within the scope of the present invention. In particular, a direct current motor may be provided, operated by a slide switch positioned on the face of the oven 1 or door 3 and able to power said motor such that it can rotate both clockwise and anticlockwise. The motor output shaft may carry a gear which cooperates with racks associated with the portions 25 and 26. In this manner the motor, when operated, moves the racks and thus said wall portions 9.

A device constructed in accordance with the invention enables the temperature at the outer surface 5 of the window 4 of the door 3 of the oven 1 to be considerably reduced. It also allows simple and accurate viewing of the interior of said oven.

What is claimed:

1. An oven comprising a door provided with a window, said window having an outer and an inner surface and a panel interposed therebetween, the panel (9) comprising at least one mobile portion (25, 26) associated with means for moving said at least one mobile portion within the door to allow visual access to the interior of the cooking chamber (2) of the oven (1), the movement of said at least one mobile portion (25, 26) being controlled by lever means inside the oven comprising a member (38) and an element (32), said lever means being actuated by the action of a pushbutton (40) provided on the outside of the oven (1).

2. An oven as claimed in claim 1, wherein the panel comprises at least one fixed portion (28, 29) with which there is associated at least one fixed side portion (30), with said fixed portions (28, 29, 30) there being associated at least one guide (27) in which the mobile portion (25, 26) slides during its operation.

3. An oven as claimed in claim 1, wherein said lever means (32, 38) is effective to move at least one arm (51, 55) having a fork-shaped free end (52, 59) acting on a pin (53, 60) fixed to the mobile portion (25, 26).

4. An oven as claimed in claim 3, wherein the lever means comprise a member (38) subjected to the action of said pushbutton (40) provided on the outside of the door (3) of the oven (1) or on a face of the oven, said member (38) being pivoted to said element (32) disposed on at lest one side portion (30) of the panel (9), there being provided on said element (32) the arm (51, 55) which acts on the mobile portion (25, 26) of said panel (9).

5. An oven as claimed in claim 4, wherein the element (32) disposed on the side portion (30) of the panel (9) moves against a spring (34) acting on one end (33) of said element (32).

6. An oven as claimed in claim 3, wherein the arm (51, 55) acting on the mobile portion (25, 26) of the panel (9) is pivoted to said panel at least at one further fixed point (54, 57).

7. An oven as claimed in claim 4, wherein the member (38) on which the pushbutton (40) acts comprises a cam (41) in which there slides a pin (42) fixed to the side portion (30) of the panel (9), said member (38) carrying a disc element (39) arranged to cooperate with a frustoconical portion (40B) of the pushbutton (40).

8. An oven as claimed in claim 7, wherein the pushbutton (40) comprises a portion (40A) projecting from an aperture (43) in the door (3), said pushbutton sliding along a guide rod (48) against a spring (46) disposed in a cavity (45) provided in said pushbutton and along a further external guide (27).

9. An oven as claimed in claim 8, wherein the further external guide (27) is a guide in which the mobile portion (25, 26) of the panel (9) slides.

* * * * *